United States Patent [19]

Yoshizawa

[11] 4,229,063

[45] Oct. 21, 1980

[54] PRESSURE TERMINAL FOR USE WITH ALUMINUM WIRE

[75] Inventor: Masaaki Yoshizawa, Gotenba, Japan

[73] Assignee: Yazaki Corporation, Tokyo, Japan

[21] Appl. No.: 969,678

[22] Filed: Dec. 15, 1978

Related U.S. Application Data

[63] Continuation of Ser. No. 840,043, Oct. 6, 1977, abandoned, which is a continuation of Ser. No. 694,172, Jun. 9, 1976, abandoned.

[30] Foreign Application Priority Data

Jun. 24, 1975 [JP] Japan ..... 50-76814

[51] Int. Cl.[3] ..... H01R 11/20

[52] U.S. Cl. ..... 339/95 R; 339/276 T

[58] Field of Search ..... 339/95, 97, 98, 256 SP, 339/258 S, 276

[56] References Cited

U.S. PATENT DOCUMENTS

| | | | |
|---|---|---|---|
| 2,783,447 | 2/1957 | Watts | 339/95 R |
| 3,309,645 | 3/1967 | Norschese | 339/98 |
| 3,355,698 | 11/1967 | Keller | 339/97 C |
| 3,798,347 | 3/1974 | Harding et al. | 339/97 C |

FOREIGN PATENT DOCUMENTS

| | | | |
|---|---|---|---|
| 1309299 | 10/1962 | France | 339/97 C |

*Primary Examiner*—Joseph H. McGlynn
*Attorney, Agent, or Firm*—Armstrong, Nikaido, Marmelstein & Kubovcik

[57] ABSTRACT

A pressure terminal for use with aluminum electric wire is formed with inwardly folded contact portions provided with pointed projections having an elasticity in the direction perpendicular to the axial direction, thereby securing a substantially constant pressure between the aluminum conductor and the terminal even in the presence of changes in strain and stress and, at the same time, preventing the reproduction of oxide films on the contacting surfaces of the conductor and terminal after connecting the terminal and the electric wire.

5 Claims, 3 Drawing Figures

PRESSURE TERMINAL FOR USE WITH ALUMINUM WIRE

This is a continuation, of application Ser. No. 840,043, filed Oct. 6, 1977. which is a continuation of Ser. No. 694,172, filed June 9, 1976 both now abandoned.

BACKGROUND OF THE INVENTION

The present invention relates to a pressure terminal for use with aluminum electric wire.

Aluminum electric wire has been in practical use for high-power cables and the like. On the other hand, attempts have been made to commercially utilize such aluminum electric wires for low-voltage use, but such attempts did not produce substantial results since there are difficult problems in connecting aluminum wires with terminals.

The crucial problems are as follows:

(1) Aluminum electric wire is inclined to produce an oxide film on its surface which makes the wire electrically nonconductive. Such oxide film appears from time to time even after being once eliminated. It is, therefore, necessary to remove such oxide films from surface of the wire and devise a suitable method to prevent them from reocurring.

(2) If a liquid containing electrolytes intrudes between contact surfaces of the aluminum electric wire and terminal, these will be corroded due to the contact corrosion effect explained later. Therefore, a special device must be considered in order to prevent intrusion of such liquid while connecting both of the terminal and aluminum wire.

(3) The aluminum conductor is more susceptible to external force than a copper conductor, and it is subject to a slight plastic deformation if such external force is prolonged on the aluminum conductor. As a result, a high pressure with which the terminal is attached to the aluminum conductor will be decreased as time elapses due to a phenomenon known as "creep." Heretofore, conventional methods overcoming the aforementioned problems have been used only in limited applications such as a high-power wiring connection, because the unit cost per connecting point has been extremely high.

SUMMARY OF THE INVENTION

An object of the present invention is to provide a pressure terminal, a pressure-connecting portion of which has a configuration permitting aluminum electric wires to be connected as simply as copper electric wires without sacrificing electrical and other properties thereof.

Essentially, according to the present invention, there is provided a pressure terminal for use with aluminum electric wire formed of a metal having a harder characteristic than aluminum comprising an electrical contact portion and a pressure-connecting portion, wherein at least one inwardly folded contact portion is provided inside the pressure-connecting portion and at least one pointed projection having an elasticity in the direction perpendicular to the axial direction is provided at the inwardly folded contact portion.

BRIEF DESCRIPTION OF THE DRAWINGS

The invention will now be described by way of example with reference to the accompanying drawings in which.

DETAILED DESCRIPTION OF THE PREFERRED EMBODIMENT

Figure 1:
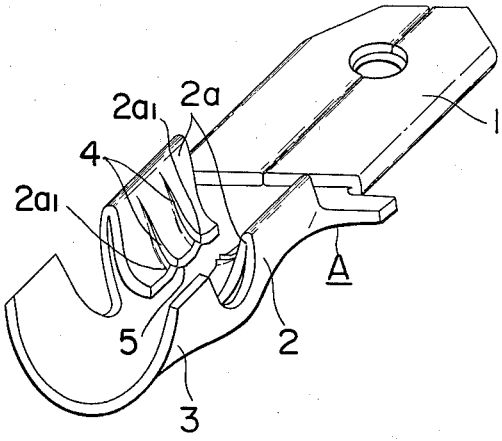
FIG. 1 is an oblique view of a pressure terminal according to the present invention.
Figure 2:
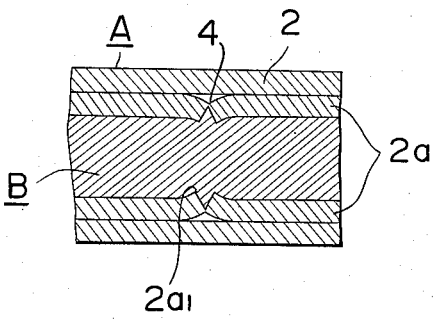
FIG. 2 is a longitudinal sectional view of a pressure terminal according to the invention showing a state in which the pressure terminal is pressure-connected to an aluminum conductor.

Referring now to FIGS. 1 and 2 showing a preferred embodiment of the present invention, A designates a pressure terminal formed of a metal such as brass having a harder characteristic than aluminum, and B designates an aluminum conductor. In the pressure terminal A, numeral 1 is an electrical contact portion to be connected to another corresponding terminal thereto. At positions succeeding the electrical contact portion, there are provided, in order, a U-shaped pressure-connecting portion 2 for securing an electric wire conductor to be connected thereto and a U-shaped pressure-connecting portion 3 for securing the covering of the electric wire.

In the U-shaped pressure-connecting portion 2 for securing the electric wire conductor, at least one inwardly folded contact plate portion 2*a* is provided. Also, the folded contact plate portion 2*a* is formed with at least one pointed projection $2a_1$ at the surface thereof which contacts the conductor. Since the pointed projection $2a_1$ is cut out of the folded contact plate portion 2*a* by a conventional stamping process, an elasticity is provided in the direction perpendicular to the axial direction of the terminal. As can be readily observed in FIGS. 1 and 2, the pointed projection or ridge 2*a*1 is formed by an incision which results in the formation of a ridge 2*a*1 on each side of the incision 4. As seen in FIG. 1, the incision 4 is the deepest in the lower or innermost end 5 of the inwardly folded contact plate portion 2*a*.

Figure 3:
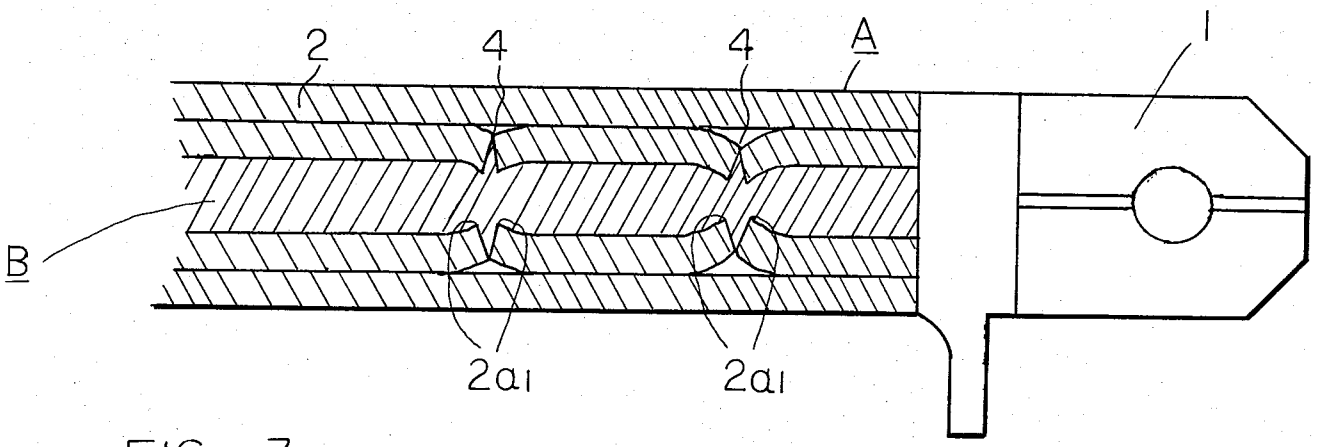
FIG. 3 is also a longitudinal sectional view.

In an arrangement wherein a plurality of pointed projections $2a_1$ for securing the conductor are provided on the contacting surface of each folded contact plate portion 2*a*, those projections at a farther site from the electrical contact portion 1 to be connected to the counterpart terminal may be formed smaller than those projections at a nearer site to the electrical contact portion 1 (as in FIG. 3) whereby permitting the tensile load to be exerted almost evenly on each pressure contact portion of the aluminum electric wire and the respective projections when the electric wire connected to the terminal is subjected to a tension, in order to prevent the aluminum electric wire from being broken while exerting the connecting pressure.

Hereafter, consideration will be given to the chemical aspect of the pressure terminal according to the present invention. If aluminum is contacted with any other metal having a higher contact potential than aluminum in the presence of an electrolytic solution, the following chemical reaction will occur:

Aluminum surface:

$$Al \rightarrow Al^{3+} + 3e^-$$

Other metal having higher potential:

$$3H^{+}+3e^{-}\rightarrow 3/2\ H^{2}$$

or $$3H^{+}+\tfrac{3}{4}O^{2}+3e^{-}\rightarrow 3/2\ H_{2}O$$

As a result of this reaction, aluminum will be dissolved in the form of $Al^{3+}$ and undergo corrosion. To prevent this, there has been proposed a method in which the terminal is plated with metal having a potential intermediate between those of aluminum and the potentially higher metal to avoid direct contact of these two kinds of metal with each other.

However, in accordance with the present invention, the outer portion of the pressure-connecting portion covers substantially the inner portion of the pressure connecting portion so that the portion 2, to be connected to the electric wire, can be improved in the sealing property thereby in order to further improve the corrosion resistance of the portion 2 by not allowing the atmosphere, to any great extent, to come in contact with the contacting portions of the electric wire and the terminal.

Generally, aluminum undergoes a strain easily from smaller stress as compared with copper. Therefore, it is difficult to obtain good electrical connection of an aluminum electric wire with a terminal by simple pressure connection as used in case of the copper electric wires. Further, repeated heat cycle tests cause gaps between the contacting surfaces of aluminum electric wires and the terminal to be formed due to a difference in coefficients of thermal expansion. In the arrangement according to the invention, since the pointed projections $2a_1$ have an elasticity, the terminal always contacts the aluminum conductor under a substantially constant contact pressure even in the presence of stress and strain changes of the aluminum conductor due to a thermal expansion, thereby permitting a good and reliable electrical connection between the terminal and electric wire and preventing the reproduction of oxide films on the contacting surfaces while maintaining an adequate securing force between the same.

What is claimed is:

1. A pressure terminal for use with aluminum electric wire formed of a metal having a hardness characteristic greater than aluminum, comprising an electric contact portion and a pressure-connecting portion, wherein at least one inwardly folded contact plate portion is provided inside said pressure-connecting portion and said inwardly folded contact plate portion is provided with at least one incision circumferentially extending from its inside portion, said incision being defined by two side portions, each said side portions forming a ridge having an elasticity in a direction perpendicular to the axial direction thereby adapted to clampingly bite the wire.

2. A pressure terminal as claimed in claim 1, wherein each incision is deepest in the lower or innermost end.

3. A pressure terminal as claimed in claim 1 wherein mirror-image inwardly folded contact plate portions are provided on opposite sides of a longitudinal centerline.

4. A pressure terminal for use with aluminum electric wire according to claim 1, wherein a plurality of said pointed projections are provided in such a manner that those projections at a farther site from said electrical contact portion are formed smaller than those projections at a nearer site to said electrical contact portion.

5. A pressure terminal as claimed in claim 4 wherein mirror-image inwardly folded contact plate portions are provided on opposite sides of a longitudinal centerline.

* * * * *